United States Patent [19]

Otto, Sr.

[11] 4,074,833

[45] Feb. 21, 1978

[54] DISPENSING CONTAINER

[76] Inventor: Joseph H. Otto, Sr., 3934 Alabama Ave. S., St. Louis Park, Minn. 55416

[21] Appl. No.: 717,160

[22] Filed: Aug. 24, 1976

[51] Int. Cl.[2] ..... G01F 11/00

[52] U.S. Cl. ..... 222/390

[58] Field of Search ..... 222/92, 95, 107, 386, 222/386.5, 388, 390, 392; 128/236; 239/324; 401/172, 173, 174, 175, 152–155

[56] References Cited

U.S. PATENT DOCUMENTS

| | | | |
|---|---|---|---|
| 1,155,859 | 10/1915 | Wirsing | 401/175 |
| 1,197,210 | 9/1916 | Jordan | 222/390 |
| 2,485,467 | 10/1949 | Weisbaum | 222/390 |
| 3,407,974 | 10/1968 | Chmielowiec | 222/389 |

FOREIGN PATENT DOCUMENTS

| | | | |
|---|---|---|---|
| 582,009 | 12/1924 | France | 222/390 |

*Primary Examiner*—Robert B. Reeves
*Assistant Examiner*—H. Grant Skaggs
*Attorney, Agent, or Firm*—Schroeder, Siegfried, Ryan, Vidas & Steffey

[57] ABSTRACT

This disclosure pertains to a dispensing container utilized in dispensing semisolids such as pastes, creams, inks, and the like. The container has a cylindrical shape including a coverable mouth portion at one end. The marginal edges at the other end of the container are turned inwardly within the container and fasten to a circular sliding member. The sliding member acts as a piston within the walls of the container delineating a compartment therein filled with the semisolid to be dispensed through the closable opening of the container. A threaded rod is disposed coaxially aligned with the longitudinal axis of the container and is threaded within an opening at one end thereof to a spider spanning the dispensing opening.

Portions of the threaded rod pass through a threaded opening in the circular sliding member. The other end of the threaded rod is secured to a knob, which when turned, causes the piston-like circular member to advance towards the dispensing opening of the container, forcing the semisolid contents thereof to be easily dispensed.

4 Claims, 4 Drawing Figures

DISPENSING CONTAINER

BACKGROUND OF THE INVENTION

1. Field of the Invention

This invention relates to dispensing containers and more particularly to that class utilizing deformable walls.

2. Description of the Prior Art

The prior art abounds with containers adapted to dispense semisolid materials. U.S. Pat. No. 381,553 issued Apr. 24, 1888 to C. H. Hollis teaches a cylindrical hollow container having a dispensing port at one end and a manually positioned slidable piston element located within the interior of the container, accessible at the other end thereof. Packing insures a tight fit between the marginal edges of the piston and the interior walls of the container. A cap is removably secured to the container covering the dispensing opening therein.

U.S. Pat. No. 3,595,449 issued on July 27, 1971 to P. W. Stump discloses a plastic piston and tubular container for dispensing semisolids, such as ice cream and the like. The piston has a flat, flexible, obturating wall; a depending peripheral skirt or flange, proportioned to guide the piston axially along the tubular container, with a flared lower edge to provide a fluidtight seal; and a central tubular hub, corrugated to provide radial flexibility, for connecting either a rodlike or tubular push device to the piston.

Both of the aforementioned patents suffer the common deficiency of relying upon a fluid-tight fit between the periphery of the piston and the interior walls of the container. This requires such containers to be fabricated with great accuracy and to possess substantial rigid characteristics above and beyond that utilized in deformable containers such as toothpaste squeeze type dispensing apparatus.

SUMMARY OF THE INVENTION

A primary object of the present invention is to provide a semisolid dispensing container wherein the force required to dispense the contents obtained utilizing the mechanical advantage available when turning a threaded screw.

Another object is to provide a dispensing container which can be fabricated from a deformable material such as aluminum, zinc, plastic or the like.

Still another object is to provide a dispensing container which dispenses its contents in direct proportion to the turning of the dispensing screw.

Yet another object is to provide a dispensing container whose length indicates the volume of remaining contents available to be dispensed therefrom.

A further object is to provide a dispensing container in accordance with the preceding objects, which is simple in construction, lightweight, relatively inexpensive, and effective for its particular purposes.

Containers adapted to dispense thickened liquids or semisolids, such as condiments, jells, creams, pastes, inks, foodstuffs, adhesives, and the like, have utilized piston-type plungers slidably housed within the walls of a rigid container. Leakage along the interface between the piston and the walls and the high cost of manufacture of such prior art devices contributed to their lack of popularity and commercial success.

The present invention, by utilizing an inverted deformable cylindrical body, eliminates the leakage problem and permits apparatus to be manufactured at a low cost. A lead screw moves the "piston" in controlled amounts thereby providing a substantial mechanical advantage, useful when dispensing semisolids possessing highly viscous characteristics. The lead screw further permits controlled amounts of material to be dispensed from the container thus providing for more economical use of the contents thereof.

These objects, as well as other objects of the present invention, will become more readily apparent after reading the following description of the accompanying drawings.

DETAILED DESCRIPTION OF THE PREFERRED EMBODIMENT

Figure 1:
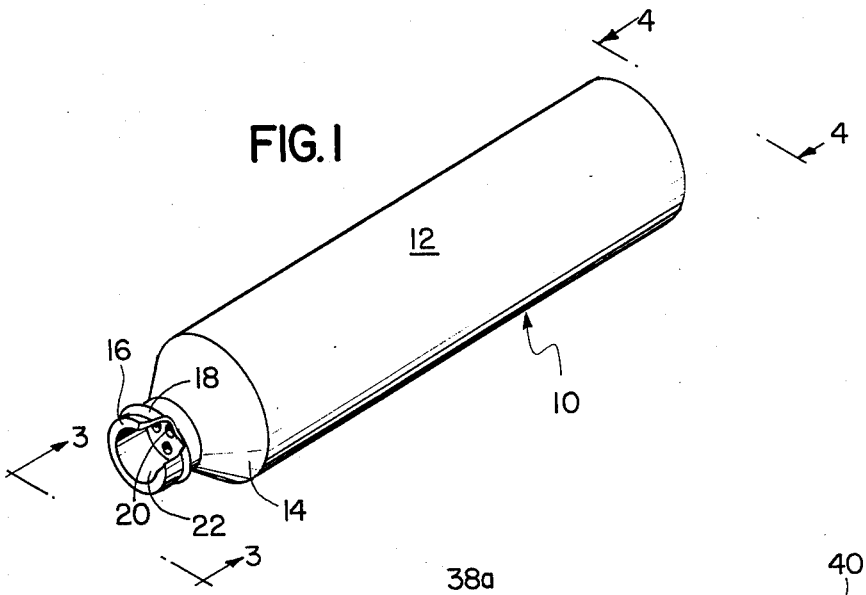
FIG. 1 is a perspective view of the present invention.

The structure and method of fabrication of the present invention is applicable to a cylindrical container fabricated from a deformable material such as a malleable metal or a soft compliant plastic material. One end of the cylinder tapers inwardly and terminates in a protruding cylindrical shape having an opening at the free end thereof and having external threads affixed to its exterior surface. A cap may be removably secured to the cylindrical protrusion by threadingly engaging the threads on the outermost surface of the protruding cylinder. A circular piston-like element is located within the interior confines of the container and is adapted to have the inwardly inverted free edges of the other end of the container fixedly secured to the marginal edges thereof. The marginal edges of the circular piston-like element are in sliding touching engagement with the interior surface of the container.

A compartment is formed intermediate the circular piston-like element and the opening in the protruding cylinder. The length of the compartment is varied as a function of the position of the circular piston-like element along the length of the container. Semisolids, residing within the compartment, may not escape from within the compartment due to the double protection afforded by the close fit of the marginal edges of the piston-like element to the interior surface of the container and by the secondary closure provided by the inverted portion of the container affixed to the piston-like element. A threaded rod threadingly engages the piston-like element and is disposed having the longitudinal axis thereof co-axially align with the longitudinal axis of the container and substantially entirely initially housed therewithin. One end of the threaded rod rotatably engages a threaded opening in a spider-like structure spanning the interior of the container disposed adjacent the protruding cylinder. As the rod rotates, portions of the rod emerge outwardly from the free end of the circular protrusion. The rod is fabricated from a brittle material, such as polypropylene, and may have the exposed portions thereof broken away from the remaining portions housed within the container. Openings in the spider structure permit the contents stored within the compartment to be dispensed outwardly from the free end of the cylindrical protrusion when the piston-like element is displaced in closer proximity to the openings, thereby shortening the length of the container. An internally threaded opening in the piston-like element engages the external threads of the rod. A knob fixedly secured to the free end of the rod facilitates convenient rotation of the threaded rod by manual manipulation by the user of the apparatus.

Rotating the knob in a first direction causes the piston-like element to slide along the length of the container. When the piston is translated towards the spider structure openings, the container length becomes shorter and the semisolid stored within the compartment is compressively ejected from the multiple openings in the spider-like structure. The pitch diameter of the threads of the rod will determine the mechanical advantage afforded the user when translating a torque-like force exerted on the knob to a translational force exerted on the slidable piston-like element. The pitch diameter also determines how much semisolid material will be dispensed for each revolution of the knob. The length of rod emerging from the projecting cylinder, serves as an indicator of the amount of semisolids dispensed from the container.

Now referring to the Figures, and more particularly to the embodiment illustrated in FIG. 1 showing the present invention 10 having a cylindrical body portion 12 and a truncated conical surface 14 affixed at one end thereof. A cylindrical protruding surface 16 is secured to conical surface 14 and is adapted with external threads 18. Threaded rod 20 is shown emerging through opening 22, disposed at one end of cylindrical surface 16.

Figure 2:
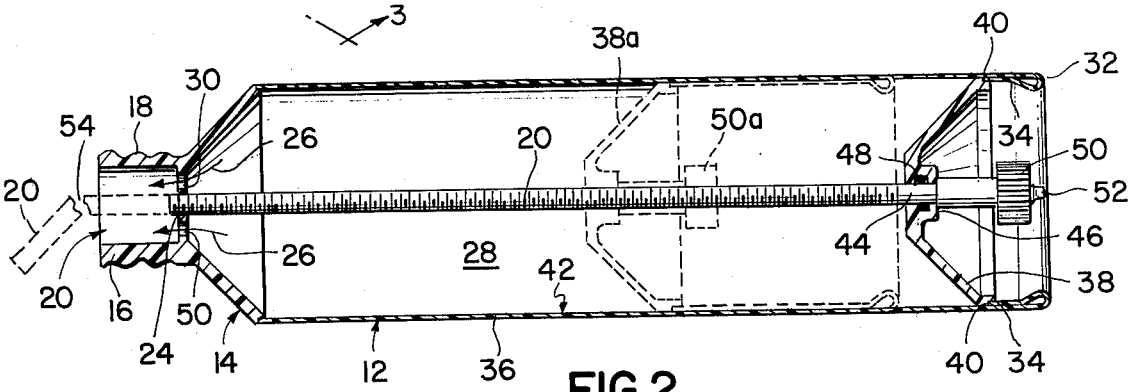
FIG. 2 is a side elevation cross-sectional view taken through the longitudinal axis of FIG. 1.

FIG. 2 illustrates cylindrical body portion 12 engaging conical surface 14 to which cylindrical surface 16 is affixed. Threaded rod 20 is shown threadingly engaging spider assembly 24 disposed spanning the interior walls of cylindrical surface 16. Arrows 26 denote the passage direction of the contents of compartment 28 of the container when passing through openings 30 in spider assembly 24. The other end 32 of cylindrical body portion 12 if formed into a rounded surface due to the marginal edge 34 of the material 36, comprising cylindrical body portion 12, being turned inwardly and folded upon itself where it is fixedly secured to cylindrical plate or piston-like element 38. The marginal edges 40 of piston-like element 38 are shown in touching engagement with the interior surface 42 of cylindrical body portion 12. Rod 20 has a portion 44 devoid of external threads passing through an opening 46 in piston-like element 38. O-ring 48, fabricated from an elastic rubber-like material provides a hermetic seal between compartment 28 and the exterior surfaces of the container. Knob 50 is fixedly secured to rod 20 and when rotated by tab 52, permits piston-like element 38 to be disposed into the position denoted by numeral **38*a*. Portions 20*a* of the threaded rod 20 emerge through opening 22 and may be broken away from the remaining intact length of rod 20 at point 54, adjacent to opening 22. A cap, not shown, may be used to threadingly engage threads 18 so as to close opening 22 and thereby totally seal compartment 28**.

Figure 3:
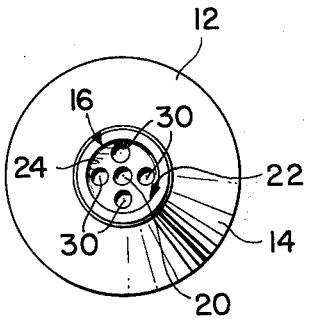
FIG. 3 is a side elevation view taken along line 3—3 viewed in the direction of arrows 3—3 as shown in FIG. 1.

FIG. 3 shows spider 24 having a plurality of openings 30 therein as viewed through opening 22 in cylindrical surface 16. Threaded rod 20 is shown emerging from spider 24.

Figure 4:
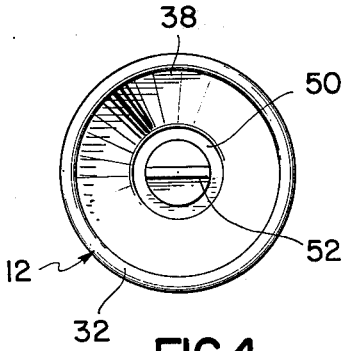
FIG. 4 is a side elevation view taken along line 4—4 viewed in the direction of arrows 4—4 as shown in FIG. 1.

FIG. 4 illustrates knob 50 having tab 52 extending across the width thereof. Piston-like element 38 is visually accessible through the curved end 32 of cylindrical body portion 12.

One of the advantages is to provide a semisolid dispensing container wherein the force required to dispense the contents obtained utilizing the mechanical advantage available when turning a threaded screw.

Another advantage is to provide a dispensing container which can be fabricated from a deformable material such as aluminum, zinc, plastic, or the like.

Still another advantage is to provide a dispensing container which dispenses its contents in direct proportion to the turning of the dispensing screw.

Yet another advantage is to provide a dispensing container whose length indicates the volume of remaining contents available to be dispensed therefrom.

A further advantage is to provide a dispensing container in accordance with the preceding objects, which is simple in construction, lightweight, relatively inexpensive, and effective for its particular purposes.

Thus there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A dispensing container comprising a hollow cylindrical body portion having a first and second end, a closable dispensing opening disposed at the first end of the cylindrical body portion, a cylindrical plate disposed within the cylindrical body portion having marginal edges disposed in slidable touching engagement with the interior surface of the cylindrical body portion, the inner edges of the cylindrical body portion at the second end disposed and folded inwardly of the cylindrical body portion and fixedly secured to the marginal edges of the plate, a rod having a threaded portion threadedly engaging the first end of the cylindrical body portion, sealing means sealing an unthreaded portion of the rod passing through an opening in the plate, portions of the rod being exposed upon passing through the dispensing opening when the plate is urged towards the dispensing opening, and a knob fixedly secured to the end of the rod externally of the cylindrical plate.

2. The dispensing container as claimed in claim 1 wherein said sealing means comprises a resilient O-ring disposed in touching engagement with the unthreaded portions of the rod and the walls of the opening in the plate.

3. The dispensing container as claimed in claim 1 including a spider-like structure secured to the hollow cylindrical body portion and disposed adjacent the dispensing opening, the rod threadedly engaging the spider-like structure, a plurality of openings in the spider-like structure communicating with the interior surface of the cylindrical body portion.

4. The dispensing container as claimed in claim 1 where the cylindrical body portion is readily deformable by movement of the cylindrical plate.

* * * * *